US009365388B2

(12) United States Patent
Matthies et al.

(10) Patent No.: US 9,365,388 B2
(45) Date of Patent: Jun. 14, 2016

(54) APPARATUS FOR CONTINUOUSLY WINDING UP A THREAD

(71) Applicant: Oerlikon Textile GmbH & Co. KG, Remscheid (DE)

(72) Inventors: Claus Matthies, Ehndorf (DE); Christian Hubert, Neumünster (DE); Jan Westphal, Schülp (DE); Friedrich Lennemann, Neumünster (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 406 days.

(21) Appl. No.: 13/937,637

(22) Filed: Jul. 9, 2013

(65) Prior Publication Data

US 2013/0292505 A1 Nov. 7, 2013

Related U.S. Application Data

(63) Continuation-in-part of application No. PCT/EP2012/050263, filed on Jan. 9, 2012.

(30) Foreign Application Priority Data

Jan. 20, 2011 (DE) ..... 10 2011 008 970

(51) Int. Cl.
*B65H 67/048* (2006.01)
*B65H 67/052* (2006.01)
*B65H 65/00* (2006.01)

(52) U.S. Cl.
CPC ..... *B65H 67/048* (2013.01); *B65H 65/00* (2013.01); *B65H 67/052* (2013.01); *B65H 2701/31* (2013.01)

(58) Field of Classification Search
CPC .... B65H 67/048; B65H 67/052; B65H 65/00; B65H 2701/31
USPC ..... 242/474.5, 474.6, 474.7
See application file for complete search history.

(56) References Cited

U.S. PATENT DOCUMENTS

| | | | | |
|---|---|---|---|---|
| 4,969,607 A | | 11/1990 | Busenhart et al. | |
| 6,042,044 A | | 3/2000 | Görke et al. | |
| 6,161,790 A | * | 12/2000 | Westrich | B65H 54/52 242/474.5 |

FOREIGN PATENT DOCUMENTS

| | | |
|---|---|---|
| DE | 197 43 278 | 4/1999 |
| DE | 10 2006 011 847 | 10/2006 |
| EP | 0 367 253 | 5/1990 |
| EP | 0 847 952 | 6/1998 |
| JP | H01156168 | 10/1989 |

OTHER PUBLICATIONS

PCT/EP2012/050263 International Search Report dated Apr. 17, 2012 (4 pages including 2 page English translation).
PCT/EP2012/050263 International Preliminary Report on Patentability dated Jul. 23, 2013 (6 pages).

* cited by examiner

*Primary Examiner* — William E Dondero
(74) *Attorney, Agent, or Firm* — Brinks Gilson & Lione; G. Peter Nichols

(57) ABSTRACT

An apparatus for continuously winding up a thread is described and includes two winding spindles that are held in a projecting manner on a rotary table and are associated with spindle drives to allow the thread to be alternately wound to form a bobbin. The rotary table can be activated in order to exchange the winding spindles between a winding region and a changing region. A moveable changing device transfers the thread between the winding spindles and during the exchange of the winding spindles, guides the thread between the winding spindles for transferring to a catching device on one of the winding spindles. The changing device has at least one deflecting thread guide and a movable feeding thread guide, which can be positioned in a deflecting position, the thread being guided at a distance from the winding spindle which receives the thread.

26 Claims, 6 Drawing Sheets

APPARATUS FOR CONTINUOUSLY WINDING UP A THREAD

This application is a continuation-in-part of and claims the benefit of priority from PCT application PCT/EP2012/050263 filed 9 Jan. 2012; and German Patent Application 10 2011 008 970.5 filed 20 Jan. 2011, the disclosure of each is hereby incorporated by reference in its entirety.

BACKGROUND

The present invention relates to an apparatus for continuously winding up a thread.

In the production of synthetic threads it is common that at the end of the process the threads are wound up to form a bobbin. To prevent process interruptions in melt spinning, the threads are continuously wound up to form a bobbin, without significant interruptions. The devices provided for a continuous winding operation comprise two winding spindles which are held in a projecting manner on a rotary table. When turning the rotary table, the winding spindles are guided alternately to a winding region and a changing region. For example, such an apparatus has been described in DE 197 43 278.

The apparatus described in DE 197 43 278 includes a movable changing device, which can be guided in the area between the two winding spindles in order to transfer the thread between the winding spindles. In this context, it is important that the thread can be received by a catching device which is arranged at the winding spindle receiving the thread. For this purpose, the changing device comprises at least a deflecting thread guide and a feeding thread guide. After exchanging the winding spindles, the changing device is moved in the thread running direction between the winding spindle dispensing the thread and the winding spindle receiving the thread. In the process, the thread is still wound onto the bobbin held on the winding spindle dispensing the thread. In a deflecting position of the changing device, the deflecting thread guide catches the thread and holds it at a distance from the winding spindle, which receives the thread and which has on its circumference an empty tube. Then, via the feeding thread guide, the thread is positioned after it has been released in a changing device, and through a backward movement of the changing device, the thread is guided into the catching device of the receiving winding spindle. To this end, the thread is caught by a curved hook of the feeding thread guide and pulled into the catching device.

However, this device has the disadvantage that the entire changing device has to be swiveled out of the deflecting position to be able to feed the thread into the catching device. Because of the fact that the device as a whole has to be activated and moved, long changing times for transferring the thread are inevitable. In addition, the pulling process exposes the thread to considerable mechanical stress, resulting in filament strands that are unraveled and damaged. Especially with so-called BCF yarns, the unraveling of the thread poses a problem because at some places the crimping is defective. In this respect, the thread segments wound onto a full bobbin as so-called wrapper fibers during the process of transferring the thread cannot be used for further processing.

EP 0 521 816 discloses another apparatus for continuously winding up a thread. In this apparatus, the changing device is held laterally to the winding spindles and interacts with a movable deflection rod, which can be pivoted from an opposite side in the thread running direction between the two winding spindles, thus deflecting the thread in the direction of the changing device. The changing device comprises a changing plate and a feeding thread guide, which is designed as a catch wing and which guides a thread running at the changing plate parallel to the winding spindle. To transfer the thread to a catching device of the winding spindle receiving the thread, the changing device is pivoted in the direction of the winding spindles in such a way that the thread is guided in contact to an empty tube of the receiving winding spindle and, through movement of the feeding thread guide, it is guided into an axially offset thread-catching slit. In this device, the contact with the empty tube exposes the thread to considerable mechanical stress, which inevitably results in damage. As a result, the wrapper fibers wound onto the full bobbin during the process of transferring the thread cannot be used for further processing.

SUMMARY

It is an object of the invention to develop an apparatus for continuously winding up a generic thread in such a way that it is possible during relatively brief changing periods to change the thread in a stress-free manner after exchanging the winding spindles.

According to the invention, the above problems are solved by providing a deflecting thread guide formed as a guide plate with a sliding edge, which has at least one deflecting section and one feeding section, which is transverse with respect thereto, and where the feeding section of the sliding edge forms a catching plane with the catching device of the winding spindle, which receives the thread.

The invention is characterized by providing the thread with limited guidance control, which is basically designed as a sliding edge of a guide plate, for transferring the thread between the winding spindles. When positioning the changing device in the deflecting position, the thread can be held merely by a deflecting section of the sliding edge of the guide plate at a distance from the winding spindle, which receives the thread. In order to transfer the thread with respective positioning to the catching device, the guide plate has a feeding section, which is transverse with respect to the deflecting section and by means of which the thread can be guided in a sliding manner directly into the catching device of the winding spindle. As a result, no further movements of the changing device are required. By designing the guide plate accordingly, the thread can be guided via the feeding section of the sliding edge directly into the catching device of the winding spindle. The mechanical stress generated through the deflection and guidance of the thread is reduced to a minimum so that the thread wound up as wrapper fiber during the changing phase does not show any significant quality changes on the winding spindle dispensing the thread.

For transferring the thread to the catching device of the winding spindle, a further embodiment of the invention is especially advantageous. In this further embodiment of the invention, the feeding thread guide with a free end portion is designed in a movable fashion in such a way that the thread for transfer to the catching device can be guided on the feeding section of the sliding edge. In this way, it is possible to further improve the process of quickly and specifically inserting the thread into the catching device.

During the process of transferring the thread, it is important to prevent the thread from slipping too early off the still thread-containing winding spindle dispensing the thread. To this end, the invention provides a further advantageous embodiment in which the guide plate is provided with a thread stopper, which limits axial movement of the thread on the winding spindle, which dispenses the thread. As a result, it is possible to guide the thread also in axial direction parallel to the winding spindles in a thread segment extending between the thread stopper and the winding spindle which receives the thread, without risking that the thread is slipping off the thread-containing winding spindle.

A further embodiment of the invention involves arranging the guide plate and the movable feeding thread guide on a retaining plate such that the retaining plate can be guided in parallel in translator fashion between a rest position lateral to the winding spindles and a deflecting position between the winding spindles. This further embodiment of the invention has the special advantage that the changing device requires only a small space within the device as a whole. In addition, it is possible to bring the changing device into deflecting position during the period of moving the rotary table, in a relatively small time frame, thus allowing for a quick changing process.

According to a further embodiment of the invention, the retaining plate comprises a guide slot that is located transverse to the direction of the winding spindle and laterally to the guide plate to allow the thread to be freely guided along the sliding edge of the guide plate, as well as to support the insertion of the thread into the catching device. For the purpose of feeding the thread into the catching device, the guide slot interacts with the sliding edge of the guide plate. As a result, the retaining plate can be extended up to the sliding edge of the guide plate in order to support the process of moving the thread through the guide plate.

For guiding the thread along the sliding edge of the guide plate, an embodiment of the invention has proved to be of value in which the feeding thread guide is formed by a pivoting catch wing which has been arranged in sandwich fashion between the retaining plate and the guide plate. In this way, it is possible to perform thread changes with low thread tension without the thread being jammed in the feeding thread guide. Furthermore, the catch wing is designed in such a way that it allows for quick movement, which results in further improvement of the changing times.

Preferably, the free end portion of the catch wing protrudes over the sliding edge of the guide plate and is held with an opposite drive end at a rotation axis, wherein during periods of movement the free end portion of the catch wing moves over the sliding edge of the guide plate.

Preferably, the drive end of the catch wing is connected with an actuator, thus allowing for quick and precise movements for transferring the thread into the catching device.

Preferably, the apparatus according to the present invention is used for winding up a plurality of threads. For this purpose, several winding points have been designed in the apparatus, wherein each of the winding spindles supports several empty tubes or several bobbins. To be able to perform a synchronous change within the winding points, it is especially advantageous to use the further embodiment of the invention in which several winding points are provided in parallel fashion next to each other and in which the retaining plate supports several guide plates and several feeding thread guides, wherein between adjacent winding points one of several guide slots is designed in the retaining plate.

In particular, the apparatus according to the present invention is used for winding up BCF yarns which include crimping and which immediately following the melt spinning process are used for further processing in manufacturing carpets. Such yarns are extremely sensitive to mechanical stress so that by means of the apparatus of the present invention even thread segments of wrapper fibers wound onto a full bobbin can be used for further processing.

BRIEF DESCRIPTION OF THE DRAWINGS

The device according to the invention shall be explained in greater detail below based on a few embodiments, with reference to the attached figures.

DETAILED DESCRIPTION

Figure 1:
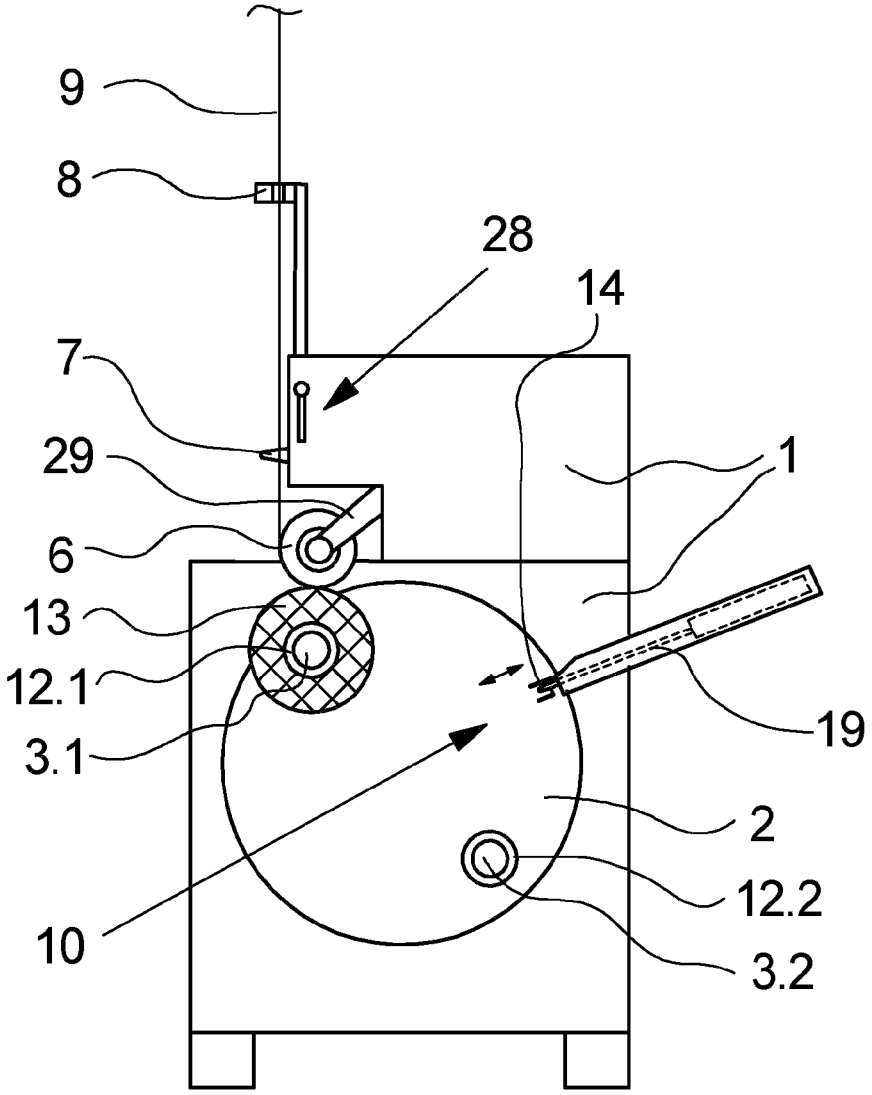
FIG. 1 schematically shows a front view of a first embodiment of the apparatus according to the present invention.
Figure 2:
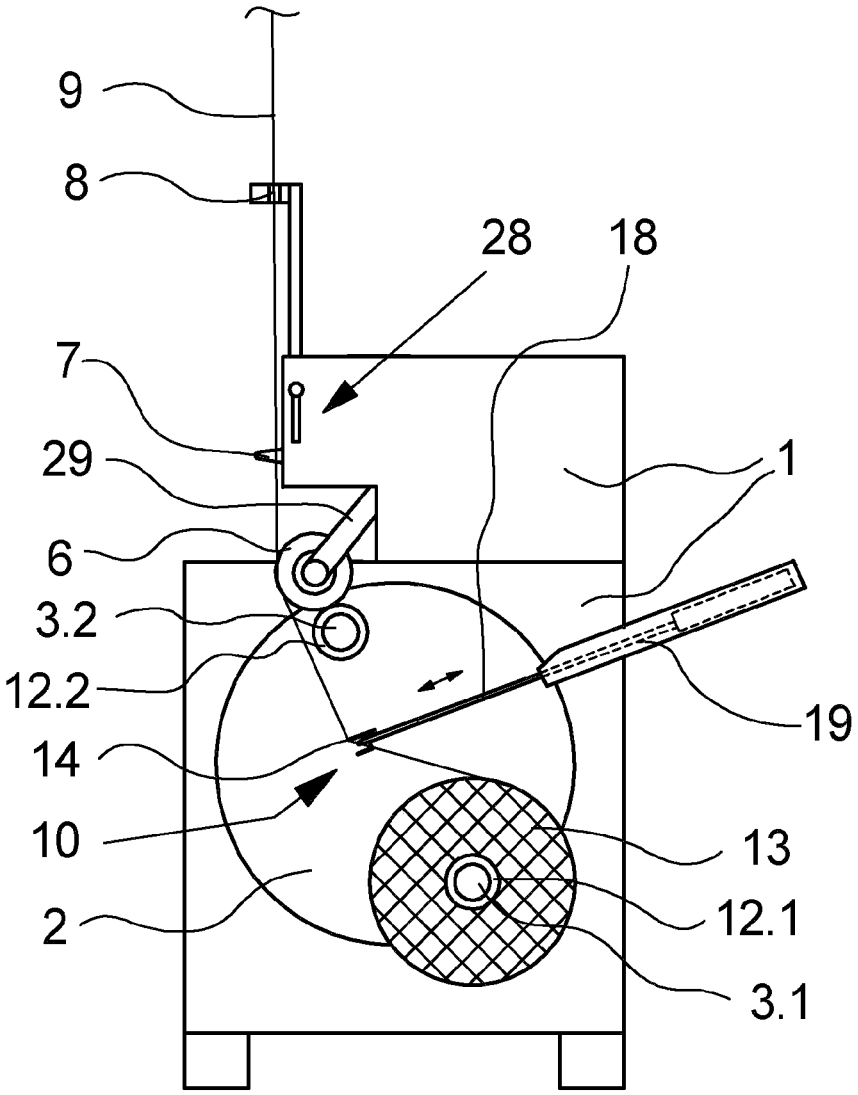
FIG. 2 schematically shows the embodiment shown in FIG. 1 in a different operational situation.
Figure 3:
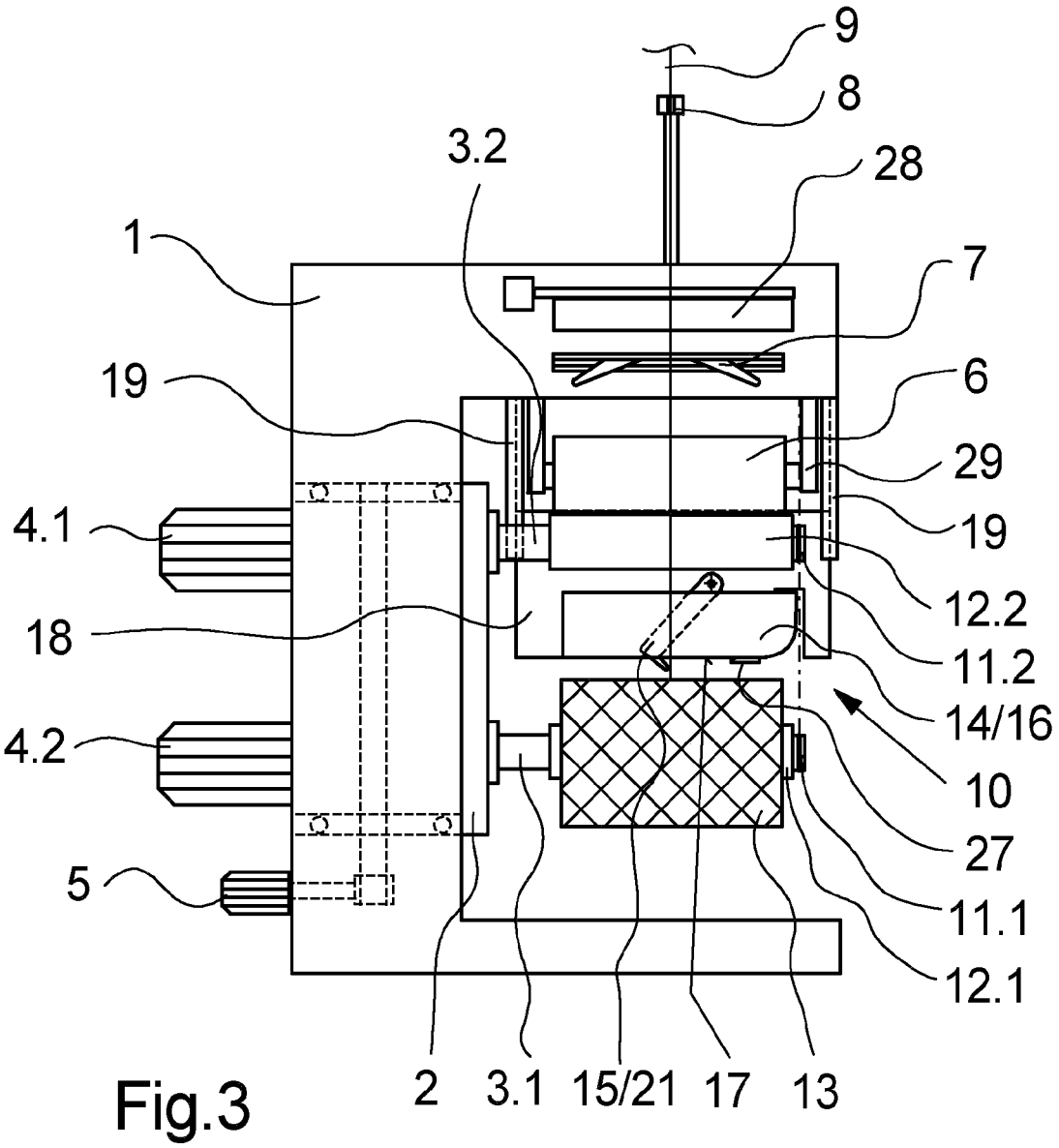
FIG. 3 schematically shows a lateral view of the embodiment shown in FIG. 2.

FIGS. 1, 2 and 3 show different views of a first embodiment of the apparatus according to the present invention for continuously winding up a thread. FIG. 1 shows a front view of the embodiment and FIG. 3 shows a lateral view. FIG. 2 shows a front view of the embodiment, wherein the embodiment in FIG. 2 differs from the device shown in FIG. 1 in that FIG. 2 shows a different operational situation. The following description applies to all figures, unless specific reference is made to any one of the remaining figures.

One embodiment of the apparatus of the present invention provides a pivoted rotary table 2 in a machine frame 1. On one side of the rotary table 2, two winding spindles 3.1 and 3.2 have been arranged in a projecting manner. The winding spindles 3.1 and 3.2 are held offset by 180° at the rotary table 2. On the opposite side of the rotary table 2, two spindle drives 4.1 and 4.2 have been arranged and are associated with the winding spindles 3.1 and 3.2. As a result, the winding spindle 3.1 is powered by the spindle drive 4.1 and the winding spindle 3.2 by the spindle drive 4.2.

On the drive side of the apparatus, a rotary table drive 5 is provided and is connected to the rotary table 2 by means of a drive system (not shown). By actuating the rotary table drive 5, the rotary table 2 can be driven counter-clockwise in the machine frame 1 so that after finishing a winding process, the winding spindles 3.1 and 3.2 can be guided between an upper winding region and a lower changing region.

The winding spindle 3.1 or 3.2 held in the winding region interacts with a pressure roller 6 that is pivoted in the machine frame 1 and a traversing device 7. In this embodiment, the traversing device 7 is shown only schematically and is preferably designed as a rotary blade. For this purpose, two rotating pairs of wings are used to move back and forth within a traverse stroke to drop the thread onto a bobbin.

A yarn guide 8 has been arranged above the machine frame in order to control the feeding of a thread 9.

The representation in FIG. 1 shows that the thread 9 is wound up to a bobbin 13 on the winding spindle 3.1. During the process of winding the thread 9 onto a bobbin 13, the rotary table 2 can be pivoted in stages or continuously by the rotary table drive 5 in such a way that with increasing diameter of the bobbin 13 the center distance between the pressure roller 6 and the winding spindle 3.1 is increasing. Preferably, the pressure roller 6 is mounted on a movable link 29. When the final diameter of the bobbin 13 on the winding spindle 3.1 has been reached, the winding spindles 3.1 and 3.2 are exchanged. For this purpose, the rotary table 2 is activated so that the winding spindle 3.2 is moved to the upper winding region and the winding spindle 3.1 to the lower changing region. At this point, it is required to transfer the thread from the winding spindle 3.1 to the winding spindle 3.2. In this respect, the winding spindle 3.2 is subsequently referred to as winding spindle receiving the thread, and the winding spindle 3.1 as winding spindle dispensing the thread.

FIGS. 2 and 3, in particular, show that the embodiment comprises a changing device 10 arranged laterally to the winding spindles. The changing device 10 is designed in moveable fashion and can be moved back and forth between a rest position and a deflecting position. FIG. 1 shows the changing device 10 in the rest position and FIGS. 2 and 3 in the deflecting position. At the same time, the changing device 10 is arranged on the side opposite from the thread guide. As a result, when the changing device 10 is adjusted between the rest position and the deflecting position, the changing device is guided automatically to the opposite thread guide of the thread wound up on the bobbin in the changing region.

Figure 4:
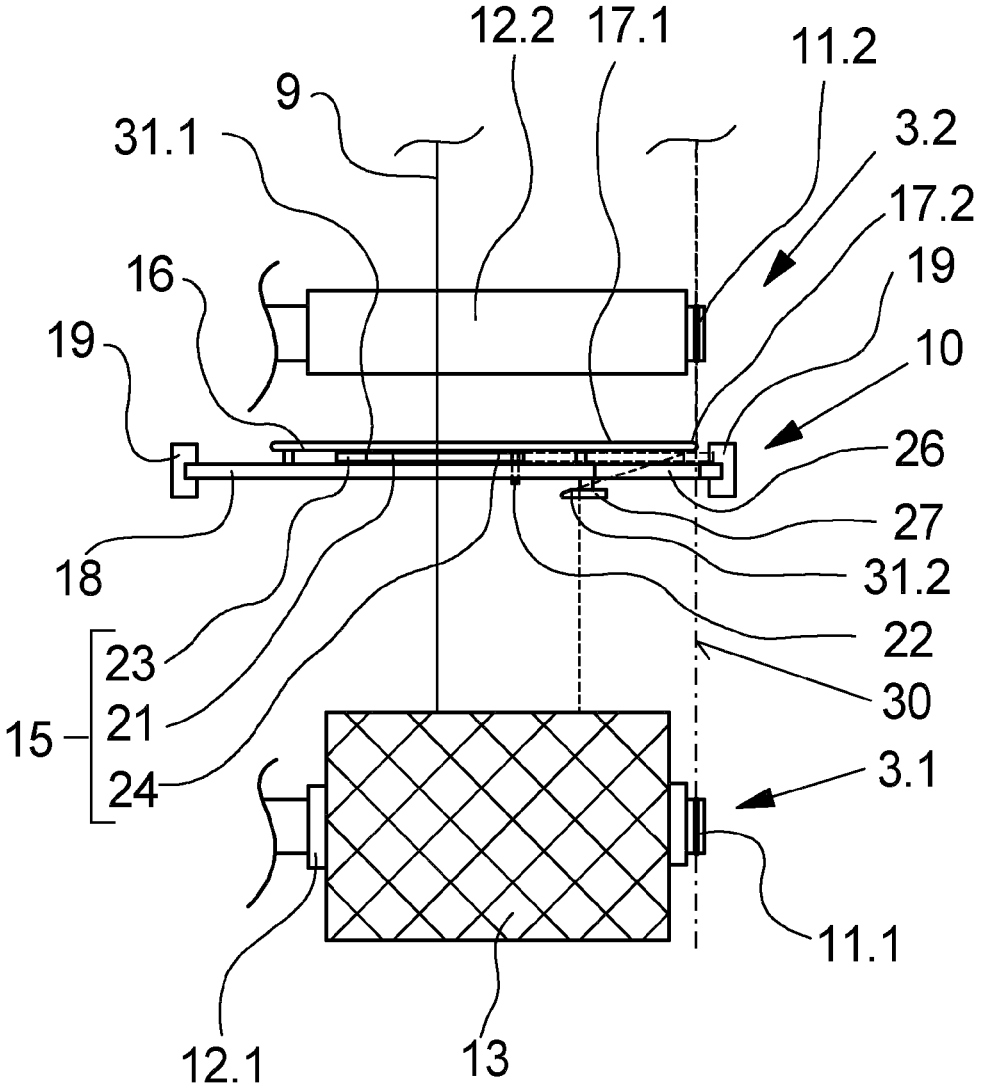
FIG. 4 schematically shows a lateral view of the changing device of the embodiment shown in FIG. 1.
Figure 5:
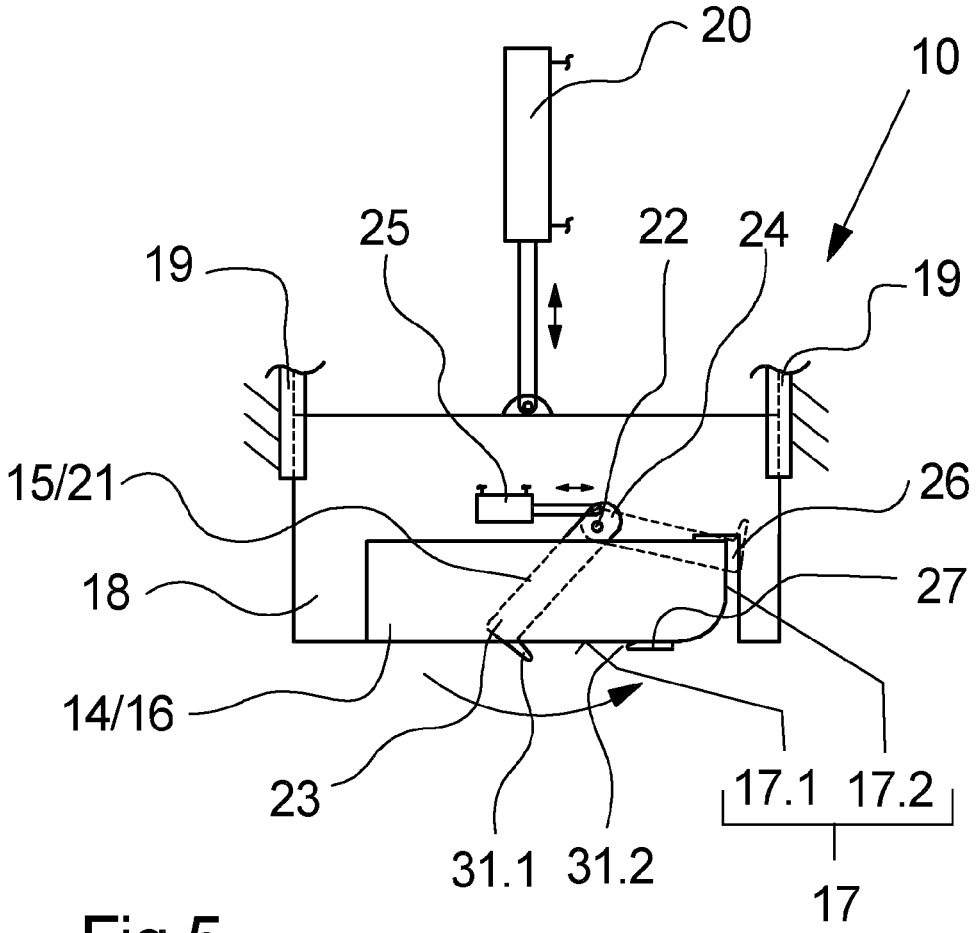
FIG. 5 schematically shows a top view of the changing device of the embodiment shown in FIG. 1.

Additional explanations of the changing device 10 are provided in FIGS. 4 and 5. FIG. 4 shows a lateral view of the changing device 10 and FIG. 5 a top view. The changing device 10 comprises a deflecting thread guide 14 which is designed as a guide plate 16 with a sliding edge 17. At the same time, the sliding edge 17 of the guide plate 16 is divided into a deflecting section 17.1 and a feeding section 17.2. The deflecting section 17.1 basically extends parallel to the winding spindles 3.1 and 3.1. The feeding section 17.2 is aligned transverse to the deflecting section 17.1 and, consequently, transverse to the winding spindle 3.1 and 3.2.

FIG. 4, in particular, shows that the sliding edge 17 forms on the deflecting section 17.2 a catching plane 30 with a catching device 11.2 designed on the winding spindle 3.2. In FIG. 4, as well as in FIG. 3, the catching plane 30 is marked by a dash-dotted line.

The representations in FIGS. 3 and 5, in particular, show that the guide plate 16 is associated with the feeding thread guide 15, which in this embodiment is formed by a catch wing 21. The catch wing 21 comprises a free end portion 23 with a guide nose 31.1. On the opposite drive end 24, the catch wing 21 is pivoted via a rotation axis 22. An actuator 25 engages on the drive end 24, through which actuator the catch wing 21 can be transferred from a catching position to a feeding position. FIGS. 3 and 5 show the catch wing 21 in the catching position. FIG. 5 shows the feeding position of the catch wing 21 by a dotted line.

The guide plate 16 and the catch wing 21 are arranged on the upper surface of a retaining plate 18. At the same time, the guide plate 16, the catch wing 21 and the retaining plate 18 are assembled in sandwich fashion in such a way that the catch wing 21 can be freely moved between the guide plate 16 and the retaining plate 18. For this purpose, the rotation axis is attached to the retaining plate 18.

FIGS. 3, 4 and 5 show that the retaining plate 18 comprises a guide slot 26 at the end of the guide plate 16 in the region of the sliding edge 17, which guide slot 26 basically extends over the entire length of the feeding section 17.1 of the sliding edge 17. As a result, it is possible that a free end of the retaining plate 18 extends until just before the sliding edge 17 of the guide socket 16, thus supporting the deflection of the thread 9 between the winding spindle 3.1 and 3.2.

The guide slot 26 in the retaining plate 18 extends underneath the guide plate 16 up to a thread stopper 27. The thread stopper 27 has been arranged on the bottom of the retaining plate 18 and protrudes with a free end opposite the sliding edge 17 of the guide plate 16. The thread stopper 27 also comprises a guide nose 31.2, which is directly opposite of the guide nose 31.1 formed on the catch wing 21.

The retaining plate 18 is designed in the form of a parallel guidance system 19 and can be lineally moved back and forth in the parallel guide system 19 via a piston-cylinder device 20.

For guiding the thread between the winding spindles 3.1 and 3.2, as well as transferring the thread to the catching device 11.2 in the winding spindle 3.2, the changing device 10 is moved into the deflecting position. At the same time, the thread 9 is caught by the deflecting section 17.1 of the sliding edge 17 of the guide plate 16. Through the traverse motion of the thread 9, the thread 9 reaches a guiding section on the guide plate 16 which is restricted by the catch wing 21 and the thread stopper 27. In this phase, the thread 9 is still wound up on the bobbin 13 of the winding spindle 3.1 dispensing the thread.

To guide the thread into the catching device 11.2 of the winding spindle 3.2 receiving the thread, the thread 9 is moved out of the traversing device 7 by means of an auxiliary device 28 (not described) and positioned in a catching position. The auxiliary device 28 is schematically indicated in FIGS. 1 to 3 and is associated with the traversing device 7. In this connection, the auxiliary device 28 can be positioned in the thread running direction before or behind the traversing device 7.

When the thread 9 is released from the traversing device 7, the actuator 25 on the changing device 10 is activated to guide the catch wing 21 in rapid movement out of its catching position and into a feeding position. With this movement of the catch wing 21, the thread 9 is caught in the thread segment between the winding spindle 3.2 and 3.1 and grazed along the sliding edge 17. In the process, the thread 9 first slides along the deflecting section 17.1 and then enters the catching plane 30 via the feeding section 17.2 of the sliding edge 17. By means of the catch wing 21, which moves with its free end portion 23 completely over the sliding edge 17, the thread is guided in a targeted manner into the catching device 11.2 of the winding spindle 3.2.

FIG. 4 shows this situation by representing the thread running direction with a dotted line.

FIG. 4 shows that the movement of the thread in the thread segment between the retaining plate 18 and the bobbin 13 is restricted by the thread stopper 27 at the circumference of the winding spindle 3.1 dispensing the thread. As a result, the thread stopper 27 prevents that the thread 9 slips off the circumference of the bobbin 13 when it is transferred through the catch wing 21.

When the thread is caught and cut in the catching device 11.2, the changing device 10 is swiveled out of its deflecting position and back to the rest position. The winding spindle 3.1 is decelerated to exchange the completed bobbin 13. At the same time, a new bobbin is wound up on the winding spindle 3.2.

Alternatively, the changing device 10 could remain in the deflecting position until the completed bobbin is decelerated. In this case, the changing device 10 can be used as a screen which prevents lint and the loose thread end from passing over to the region where the new bobbin is being wound up.

Figure 6:
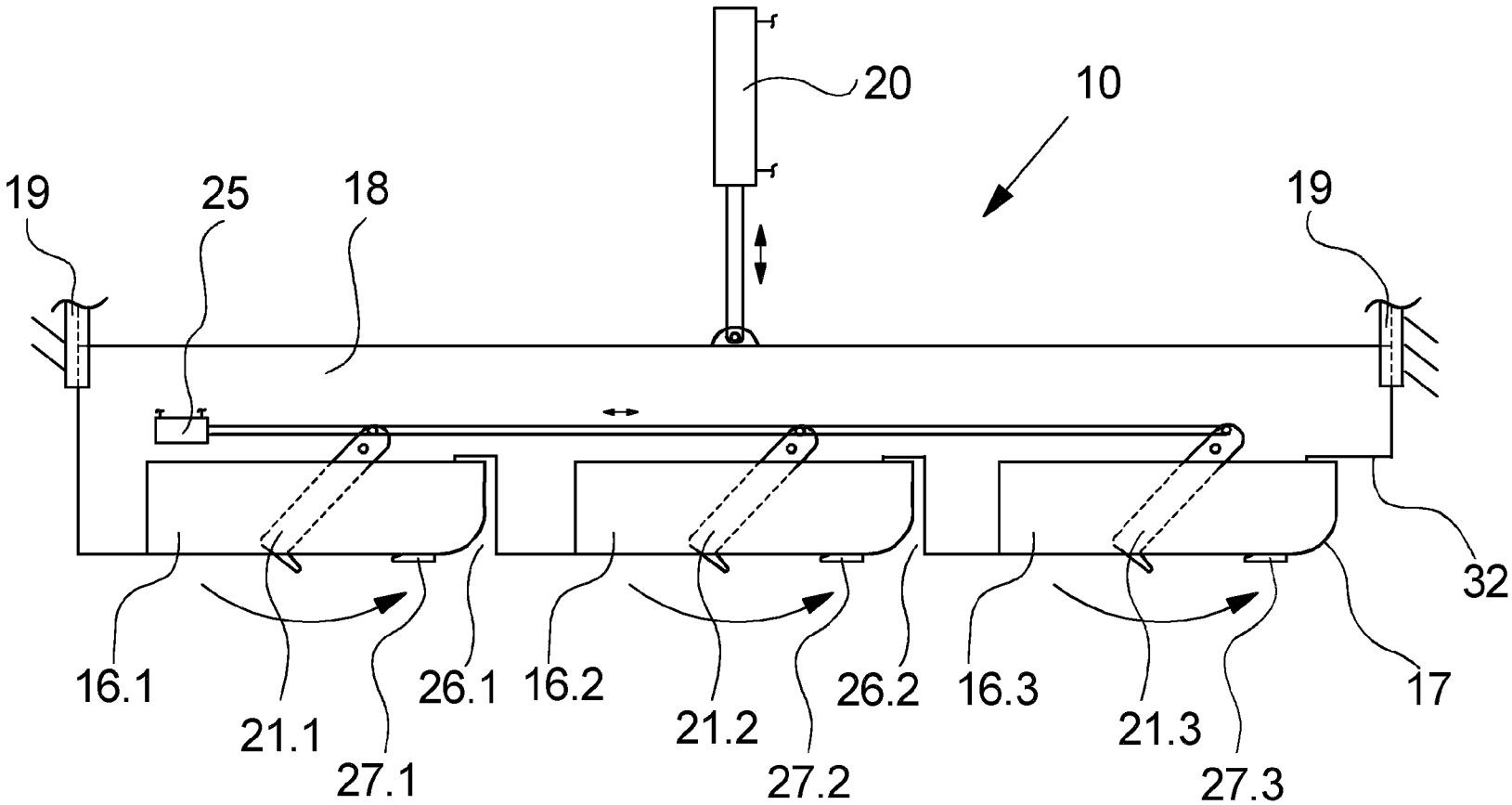
FIG. 6 schematically shows a top view of a changing device of a further embodiment of the apparatus according to the present invention.

The embodiment of the device shown in FIGS. 1 to 3 can be supplemented with further winding points, thus allowing several bobbins to be wound up next to each other on the winding spindles 3.1 and 3.2. To transfer the threads synchronously between the winding spindles 3.1 and 3.2 in such a multi-threaded winding device, FIG. 6 shows a diagram of an embodiment of a changing device which can be used, for example, for thread guidance comprising three threads guided in parallel in an apparatus with three winding points. The embodiment of the changing device is shown from the top. To this end, three guide plates 16.1, 16.2 and 16.3 are arranged on a retaining plate 18 with a distance between each other. Each of the guide plates 16.1, 16.2 and 16.3 are identical to the guide plate 16 in accordance with the above-mentioned embodiment, so that no further description is required at this point. Each of the guide plates 16.1, 16.2 and 16.3 is associated with a respective catch wing 21.1, 21.2 and 21.3, which can be pivoted on the retaining plate 18 and which moves synchronously via the actuator 25. The catch wings 21.1, 21.2 and 21.3 are also designed in identical manner in accordance with the above-mentioned embodiment.

On the bottom side of the retaining plate 18, three thread stoppers 27.1, 27.2 and 27.3 have been provided with a distance between each other and positioned upstream of the sliding edges 17 of the guide plates 16.1, 16.2 and 16.3.

On the retaining plate 18, between the adjacent guide plates 16.1 and 16.2, as well as 16.2 and 16.3, a respective guide slot 26.1 and 26.2 has been provided to allow the sliding edge 17 of the guide plates 16.1 and 16.2 to guide the threads into the catching devices. On the right side, in the region of the last guide plate 16.3, the retaining plate 18 has been provided with a recess 32, which allows the thread to freely move along the sliding edge 17 of the guide plate 16.3.

The parallel guidance system 19 of the retaining plate 18 is designed in a partitioned manner and is moved back and forth between the rest position and the deflecting position via a piston-cylinder device 20.

The function of transferring the threads between the winding spindles has an identical design at the respective winding points and is performed in accordance with the above-mentioned embodiment. It is therefore not required to provide an additional description of an apparatus with several winding points.

The embodiment of the changing device shown in FIG. 6 provides a high degree of change reliability when operating with several winding points because the synchronously powered catch wings catch and guide the threads in a quick and repeatable manner. In addition, the system requires very brief changing times for transferring the threads.

In particular, the apparatus according to the present invention is characterized by the fact that the thread is transferred by quick movements after exchanging the winding spindles. Thus, it is possible to reduce the periods for deflecting the thread. Furthermore, it is possible to guide the thread reliably even with low thread tension, allowing for particularly stress-free thread guidance without mechanically damaging individual filaments. The special design of the thread guiding means on the changing device comprising a sandwich structure prevents jamming and shearing of the thread when it is transferred to the catching device. In each phase of the changing process, the thread can be securely guided along the sliding edge of the guide plate. The design of the guide plate determines the guidance path of the thread, thus avoiding any contact between the thread and the winding spindle receiving the thread. It is possible to force-feed the thread into the catching device.

REFERENCE LIST

1 machine frame
2 rotary table
3.1, 3.2 winding spindle
4.1, 4.2 spindle drive
5 rotary table drive
6 pressure roller
7 traversing device
8 yarn guide
9 thread
10 changing device
11.1, 11.2 catching device
12.1, 12.2 empty tube
13 bobbin
14 deflecting thread guide
15 feeding thread guide
16 guide plate
17 sliding edge
17.1 deflecting section
17.2 feeding section
18 retaining plate
19 parallel guidance
20 piston-cylinder device
21 catch wing
22 rotation axis
23 free end portion
24 drive end
25 actuator
26 guide slot
27 thread stopper
28 auxiliary device
29 movable link
30 catching plane
31.1, 31.2 guide nose
32 recess

The invention claimed is:

1. An apparatus for continuously winding up a thread comprising a. two winding spindles held in a projecting manner on a rotary table with each associated with a respective spindle drive;

b. a rotary table drive for moving the rotary table so that one of the winding spindles moves between a winding region and a changing region;

c. a pressure roller and a traversing device both of which interact with one of the winding spindles held in the winding region for winding up the thread; and, d. a changing device associated with the winding spindles and which guides the thread between the winding spindles for transferring the thread to a catching device on one of the winding spindles receiving the thread, wherein the changing device comprises at least one deflecting thread guide and one movable feeding thread guide, wherein the changing device can be positioned with the deflecting thread guide and the movable thread guide in a deflecting position in which the thread can be guided with a distance from one of the winding spindles receiving the thread, wherein the deflecting thread guide includes a guide plate with a sliding edge that has at least one deflecting section and one feeding section, which is transverse to the deflecting section, wherein the deflecting section guides the thread without contact with the winding spindle receiving the thread, and wherein the feeding section of the sliding edge forms a catching plane with the catching device of the winding spindle receiving the thread.

2. An apparatus according to claim 1, wherein the feeding thread guide includes a free end portion configured to move in a manner so that the thread can be guided on the feeding section of the sliding edge of the guide plate to be transferred to the catching device.

3. An apparatus according to claim 2, wherein the guide plate includes a thread stopper which limits an axial movement of the thread on a winding spindle which dispenses the thread.

4. An apparatus according to claim 3, wherein the guide plate and the movable feeding thread guide are arranged on a retaining plate by means of a parallel guide that can be translated between a rest position lateral to the winding spindles and a deflecting position between the winding spindles.

5. An apparatus according to claim 3, wherein several winding points are provided in parallel fashion next to each other and such that the retaining plate supports several guide plates and several feeding thread guides, wherein between adjacent retaining plates one of several guide slots is designed in the retaining plate.

6. An apparatus according to claim 2, wherein several winding points are provided in parallel fashion next to each other and such that the retaining plate supports several guide plates and several feeding thread guides, wherein between adjacent retaining plates one of several guide slots is designed in the retaining plate.

7. An apparatus according to claim 1, wherein the guide plate includes a thread stopper which limits an axial movement of the thread on a winding spindle which dispenses the thread.

8. An apparatus according to claim 7, wherein the guide plate and the movable feeding thread guide are arranged on a retaining plate by means of a parallel guide that can be translated between a rest position lateral to the winding spindles and a deflecting position between the winding spindles.

9. An apparatus according to claim 7, wherein several winding points are provided in parallel fashion next to each other and such that the retaining plate supports several guide plates and several feeding thread guides, wherein between adjacent retaining plates one of several guide slots is designed in the retaining plate.

10. An apparatus according to claim 1, wherein the guide plate and the movable feeding thread guide are arranged on a retaining plate by means of a parallel guide that can be translated between a rest position lateral to the winding spindles and a deflecting position between the winding spindles.

11. An apparatus according to claim 10, wherein the retaining plate comprises a guide slot that is located transverse to the direction of the winding spindles and laterally to the guide plate, and wherein the guide slot interacts with the sliding edge of the guide plate for feeding the thread into the catching device.

12. An apparatus according to claim 11, wherein the feeding thread guide includes a pivoting catch wing arranged in sandwich fashion between the retaining plate and the guide plate.

13. An apparatus according to claim 12, wherein the free end portion of the catch wing protrudes over the sliding edge of the guide plate and is held with a drive end at a rotation axis, wherein during periods of movement, the free end portion of the catch wing moves over the sliding edge of the guide plate.

14. An apparatus according to claim 13, wherein the drive end portion of the catch wing is connected to an actuator.

15. An apparatus according to claim 10, wherein the feeding thread guide includes a pivoting catch wing arranged in sandwich fashion between the retaining plate and the guide plate.

16. An apparatus according to claim 15, wherein the free end portion of the catch wing protrudes over the sliding edge of the guide plate and is held with a drive end at a rotation axis, wherein during periods of movement, the free end portion of the catch wing moves over the sliding edge of the guide plate.

17. An apparatus according to claim 16, wherein the drive end portion of the catch wing is connected to an actuator.

18. An apparatus according to claim 1, wherein several winding points are provided in parallel fashion next to each other and such that the retaining plate supports several guide plates and several feeding thread guides, wherein between adjacent retaining plates one of several guide slots is designed in the retaining plate.

19. An apparatus for continuously winding up a thread comprising a. two winding spindles held in a projecting manner on a rotary table with each associated with a respective spindle drive;

b. a rotary table drive for moving the rotary table so that one of the winding spindles moves between a winding region and a changing region;

c. a pressure roller and a traversing device both of which interact with one of the winding spindles held in the winding region for winding up the thread; and, d. a changing device associated with the winding spindles and which guides the thread between the winding spindles for transferring the thread to a catching device on one of the winding spindles receiving the thread, wherein the changing device comprises at least one deflecting thread guide and one movable feeding thread guide, wherein the changing device can be positioned with the deflecting thread guide and the movable thread guide in a deflecting position in which the thread can be guided with a distance from one of the winding spindles receiving the thread, wherein the deflecting thread guide includes a guide plate with a sliding edge that has at least one deflecting section and one feeding section, which is transverse to the deflecting section, and wherein the feeding section of the sliding edge forms a catching plane with the catching device of the winding spindle receiving the thread, and wherein the guide plate includes a thread stopper which limits an axial movement of the thread on a winding spindle which dispenses the thread.

20. An apparatus according to claim 19, wherein the guide plate and the movable feeding thread guide are arranged on a retaining plate by means of a parallel guide that can be translated between a rest position lateral to the winding spindles and a deflecting position between the winding spindles.

21. An apparatus for continuously winding up a thread comprising:

a. two winding spindles held in a projecting manner on a rotary table with each associated with a respective spindle drive;

b. a rotary table drive for moving the rotary table so that one of the winding spindles moves between a winding region and a changing region;

c. a pressure roller and a traversing device both of which interact with one of the winding spindles held in the winding region for winding up the thread; and, d. a changing device associated with the winding spindles and which guides the thread between the winding spindles for transferring the thread to a catching device on one of the winding spindles receiving the thread, wherein the changing device comprises at least one deflecting thread guide and one movable feeding thread guide, wherein the changing device can be positioned with the deflecting thread guide and the movable thread guide in a deflecting position in which the thread can be guided with a distance from one of the winding spindles receiving the thread, wherein the deflecting thread guide includes a guide plate with a sliding edge that has at least one deflecting section and one feeding section, which is transverse to the deflecting section, wherein the feeding section of the sliding edge forms a catching plane with the catching device of the winding spindle receiving the thread, wherein the guide plate and the movable feeding thread guide are arranged on a retaining plate by means of a parallel guide that can be translated between a rest position lateral to the winding spindles and a deflecting position between the winding spindles, and wherein the feeding thread guide includes a pivoting catch wing arranged in sandwich fashion between the retaining plate and the guide plate.

22. An apparatus according to claim 21, wherein the free end portion of the catch wing protrudes over the sliding edge of the guide plate and is held with a drive end at a rotation axis, wherein during periods of movement, the free end portion of the catch wing moves over the sliding edge of the guide plate.

23. An apparatus according to claim 22, wherein the drive end portion of the catch wing is connected to an actuator.

24. An apparatus for continuously winding up a thread comprising:

a. two winding spindles held in a projecting manner on a rotary table with each associated with a respective spindle drive;

b. a rotary table drive for moving the rotary table so that one of the winding spindles moves between a winding region and a changing region;

c. a pressure roller and a traversing device both of which interact with one of the winding spindles held in the winding region for winding up the thread; and, d. a changing device associated with the winding spindles and which guides the thread between the winding spindles for transferring the thread to a catching device on one of the winding spindles receiving the thread, wherein the changing device comprises at least one deflecting thread guide and one movable feeding thread guide, wherein the changing device can be positioned with the deflecting thread guide and the movable thread guide in a deflecting position in which the thread can be guided with a distance from one of the winding spindles receiving the thread, wherein the deflecting thread guide includes a guide plate with a sliding edge that has at least one deflecting section and one feeding section, which is transverse to the deflecting section, wherein the feeding section of the sliding edge forms a catching plane with the catching device of the winding spindle receiving the thread, wherein the guide plate and the movable feeding thread guide are arranged on a retaining plate by means of a parallel guide that can be translated between a rest position lateral to the winding spindles and a deflecting position between the winding spindles, wherein the retaining plate comprises a guide slot that is located transverse to the direction of the winding spindles and laterally to the guide plate, and wherein the guide slot interacts with the sliding edge of the guide plate for feeding the thread into the catching device, and wherein the feeding thread guide includes a pivoting catch wing arranged in sandwich fashion between the retaining plate and the guide plate.

25. An apparatus according to claim 24, wherein the free end portion of the catch wing protrudes over the sliding edge of the guide plate and is held with a drive end at a rotation axis, wherein during periods of movement, the free end portion of the catch wing moves over the sliding edge of the guide plate.

26. An apparatus according to claim 25, wherein the drive end portion of the catch wing is connected to an actuator.

* * * * *